US005305928A

United States Patent [19]

Verdaguer

[11] Patent Number: 5,305,928

[45] Date of Patent: Apr. 26, 1994

[54] SQUEEZABLE FEEDING CONTAINER

[76] Inventor: Roberto Verdaguer, 8315 NW. 64 St., Bay 5, Miami, Fla. 33166

[21] Appl. No.: 72,463

[22] Filed: Jun. 4, 1993

[51] Int. Cl.[5] ..... B67D 1/07

[52] U.S. Cl. ..... 222/192; 222/205; 30/125; 141/18

[58] Field of Search ..... 222/205, 192, 212, 553, 222/555, 106; 141/18, 319; 30/124, 125, 141; 426/115, 117; 215/228, DIG. 5; 206/217

[56] References Cited

U.S. PATENT DOCUMENTS

| | | | |
|---|---|---|---|
| D. 191,387 | 9/1961 | Hansen | 215/DIG. 5 |
| 2,041,351 | 5/1936 | Jones | 222/553 |
| 2,252,119 | 8/1941 | Edmons | 30/125 X |
| 2,837,822 | 6/1958 | Wille | 30/125 |
| 2,953,170 | 9/1960 | Bush | 141/18 |
| 3,133,679 | 5/1964 | Brown | 222/205 |
| 3,383,018 | 5/1968 | Grimsley | 141/18 X |
| 3,612,358 | 10/1971 | Massa | 222/192 X |
| 3,658,213 | 4/1972 | Plumer | 222/555 X |
| 4,019,956 | 5/1978 | Gebhard | 222/548 X |
| 4,830,222 | 5/1989 | Read | 222/192 X |
| 4,888,188 | 12/1989 | Castner, Sr. et al. | 426/115 X |

FOREIGN PATENT DOCUMENTS

| | | | |
|---|---|---|---|
| 498708 | 2/1951 | Belgium | 222/553 |
| 1328639 | 12/1963 | France | 141/319 |
| 2584931 | 1/1987 | France | 222/192 |

*Primary Examiner*—Gregory L. Huson
*Attorney, Agent, or Firm*—Malloy & Malloy

[57] ABSTRACT

The present invention relates to a container which includes an applicator structure, preferably in the form of a spoon secured to the open end of the container in which food is stored. Squeezing and/or tilting of the container allows food to pass through the interior of the spoon and be delivered to an infant's mouth. A valve structure is disposed in flow-regulating relation between the food within the container and the applicator spoon. The valve may be moved between an open and closed position to prevent spillage and/or selectively allow food to pass onto the spoon when feeding of the infant is desired.

6 Claims, 2 Drawing Sheets

SQUEEZABLE FEEDING CONTAINER

BACKGROUND OF THE INVENTION

1. Field of the Invention

This invention relates to a food container having a spoon or like applicator structure attached thereto wherein food may be delivered from the interior of the container to the spoon applicator to facilitate feeding of infants or others who cannot easily feed themselves.

2. Description of the Prior Art

The existence of feeding bottles or containers made from a squeezable material and used in combination with some type of applicator such as a nipple, spoon, etc. are quite well known in the prior art. Prior art devices have recognized a spillage or leakage problem associated with these "baby bottles." In order to overcome such problems, the prior art provides a round tab-like structure inserted relative to the spoon, nipple or like applicator at a location to block the flow of food therethrough. Such insertion of the round tab requires disassembly or disconnection of the spoon or like applicator from the remainder of the container. When dissembling the bottle from the spoon, it is of course necessary that the operator handle and touch inside portions of both the applicator and the container. This very possibly may cause the food within the container to become contaminated either from the hands of the user or by contaminants in the atmosphere.

After disassembling, the user must also find a clean place to store the tab and keep this tab away from the infants in order to avoid swallowing and possibly choking if such tab comes within the reach of the infant. An additional problem associated with such prior art structures is that the tabs frequently become lost. The existing baby bottle with spoon or like applicator is not convenient for traveling long or short distances because if the tab is not inserted, it does not provide an easy, hygienic way of keeping the food within the interior of the container and prevent spillage or leakage.

When carrying such a prior art bottle inside a diaper bag or any other type of carrier structure the parents use, the prior art bottle or container can easily be tilted or inadvertently oriented in an attitude to facilitate leakage of the food from within the container through the applicator spoon. This obviously results in the surrounding articles or the interior of the bag becoming stained.

Accordingly, an important feature of the present invention is to provide a valve structure that will allow the applicator spoon to be separated from the supply of food within the hollow interior of the container. When being used, such a valve structure may be easily positioned into an open position which allows the food to easily flow from the interior of the bottle to the applicator spoon merely by tilting and possibly gently squeezing the container. When not in use, the valve structure may be positioned in a closed position which prevents the food from pouring or leaking from the interior of the bottle into the applicator spoon should the bottle be tilted sideways or inverted. Such a valve structure would also prevent the loss of food due to leakage. This is important if the prepared food is the only food available due to a special formula or preparation.

SUMMARY OF THE INVENTION

The present invention relates to a "baby bottle" or container from which babies or infants are fed. In a preferred embodiment and typically in the prior art, such containers are formed from a flexible material to allow at least a small amount of squeezing of the container to facilitate removal of the food from within the hollow interior portion of the container. This is particularly true wherein the container is used in combination with a spoon-like structure so being as an applicator. Such an applicator spoon is used where it is desired to feed the infant foods in a semi-solid state other than milk or liquid. In operation, the container is tilted to the desired angle and gently squeezed. Such orientation and squeezing urges the food from within the container to pass through an open end of the container into the interior of the elongated applicator spoon. The food travels along a desired flow path to the outer end of the spoon. Once it reaches this location, the outer end or bowl portion of the spoon is placed in the infant's mouth for feeding.

In addition to the above, the present invention comprises as an important feature thereof, a valve means. Such valve means is preferably placed adjacent the open end of the container and is structured to regulate flow of food from within the hollow interior portion of the container to within the flow path on the interior of the applicator spoon. More specifically, the valve means may be structured for selective placement between an open position and a closed position. The open position allows the food to freely flow from the interior of the container along the interior of the spoon and to the outer end thereof for dispensing and feeding of the food into the infant's mouth. To the contrary, the closed position locks all access of the interior of the container from the flow path or interior of the applicator spoon.

In a preferred embodiment, to be described in greater detail hereinafter, the valve means is more specifically defined by a first plate which is removably attached in overlying at least partially covering relation to the open access end of the container. This first plate includes a first passage integrally formed therein through which food may pass when the valve means is in the aforementioned open position. The valve means further includes a second plate which is disposed in immediately adjacent, confronting and movable engagement with the first plate. This second plate also includes a passage extending therethrough which is dimensioned to allow passage of food therethrough similar to the first passage of the first plate. Importantly, the second passage in the second plate is in direct alignment and in fact defines the open innermost end of the applicator spoon structure. Therefore, any food passing through the second passage will be completely directed into the interior of the applicator spoon and along the flow path defined therein so that such food will be delivered to the outermost end of the spoon for delivery to the infant's mouth.

The open position is defined by the first and second plate being relatively disposed to one another such that the first and second passages therein are in substantially coaxial alignment with one another. This will establish a clear path of fluid flow of the food from within the interior of the container to the interior of the spoon structure and along the flow path to the outer end of the applicator spoon.

In order to accomplish the alignment and positioning of the aforementioned first and second valve plates in the open position, at least one of these plates is rotatable about a common central axis of rotation relative to the other plate. This of course is accomplished manually such that the first and second passages may be selectively positioned into and out of axial alignment dependent upon whether the user wishes the valve to be in its open or closed position.

Also in a preferred embodiment to be described in greater detail hereinafter, the second plate is fixedly attached to the innermost end of the spoon so as to maintain fixed alignment between the open innermost end of the flow path of the applicator spoon and the second passage. Therefore, the second valve plate and the spoon itself is rotatable relative to the first valve plate to accomplish selective disposition of the valve structure between its open and closed positions.

Other structural features include a retaining collar which is removably secured, as by a threaded connection, to and about the open end of the container The retaining collar is structured to effectively sandwich the first and second plates into confronting engagement with one another but is also structured to allow rotational movement of the second plate relative to the retaining structure or collar as well as the first plate so as to allow proper positioning of the valve structure and thereby regulate flow of food out of the hollow interior portion of the container.

Naturally, all the various components of the container includng the applicator spoon, container body and first and second plates of the valve structure may be totally disassembled for cleaning or to allow the food to be closed within or removed from the hollow interior portion of the container.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying figures, the present invention is directed towards a feeding assembly or more specifically a feeding container generally indicated as 10. The container assembly includes a container 12 having a hollow interior portion as at 14 in which food is placed and stored prior to being consumed by the infant. The container 12 includes an open end as at 16 sufficiently large to provide access to the interior 14 and allow food to be added or removed therefrom.

Figure 1:
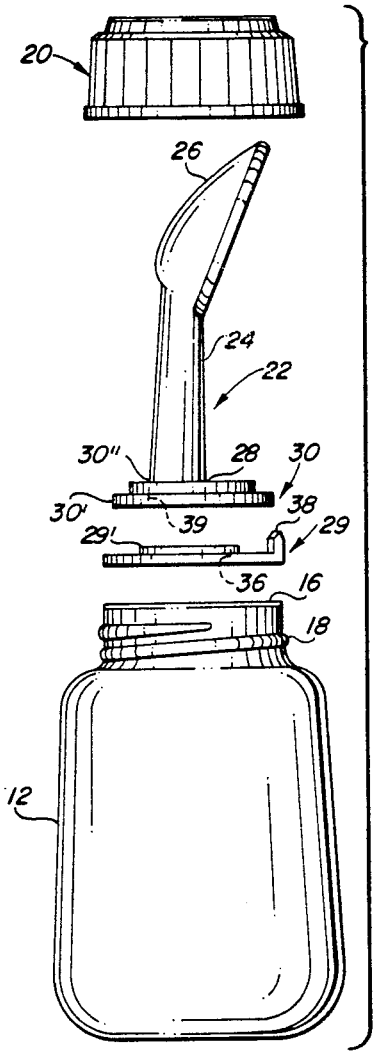
FIG. 1 is an exploded view of the container of the present invention and the various components defined thereby.

As shown primarily in FIG. 1, the exterior surface of a surrounding skirt adjacent and defining the open end 16 of container 12 may be externally threaded as at 18 or otherwise structured to accommodate the removable attachment of a retaining means generally indicated as 20. The retaining means 20 will be described in greater detail hereinafter.

One important feature of the present invention is the provision of an applicator means generally indicated as 22. The applicator means is in the form of an elongated spoon having an elongated base portion as at 24 and an outermost end in the form of a spoon bowl or like area 26. The inner end of the spoon as at 28 is attached to a plate 30, also which will be explained in greater detail hereinafter.

Figure 3:
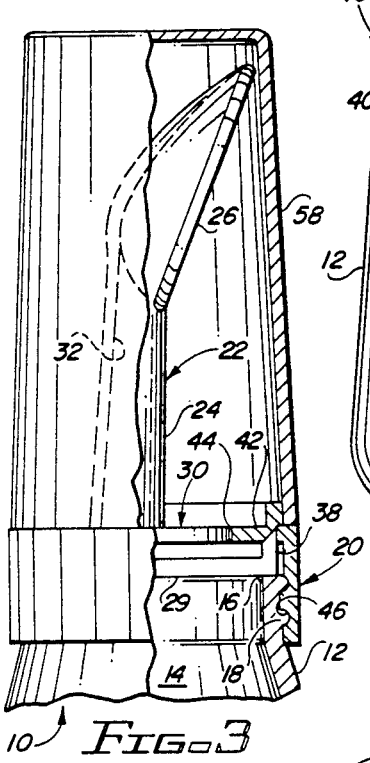
FIG. 3 is a sectional view in detail showing the relative components of a valve structure associated with the present invention.

The interior of the applicator spoon structure 22 includes a hollow, elongated flow path generally indicated as 32 (see FIG. 3). The flow path 30 serves effectively as an interior channel to direct food issuing from the open end 16 of the container 12 into the interior of the applicator spoon 22 throughout its length so the food will exit at the outermost end or at the spoon bowl 26. From this point it is of course directed into the infant's mouth for consumption.

An important feature of the present invention is the provision of a valve means disposed and structured to regulate the flow of food from the interior 14 of the container 12 into the flow path 32 on the interior of the applicator spoon 22. This valve means may be defined by a first plate 29 and a second plate 30 which, was described above, as being fixedly attached to the innermost end 28 of the applicator spoon 22. The first plate 29 is shown in detail in FIGS. 5 and 6 and includes a passage as at 36 formed therein. In addition the first plate 29 includes an arcuate, upstanding projection 38. As shown in FIG. 3, the operative location of the first plate 29 is in substantially overlying and at least partially covering relation to the open end 16 of the container 12. Similarly, the second plate 30 is disposed in confronting engagement with the first plate 29 and also in substantially overlying relation to the open end 16. The dimension and configuration of the applicator spoon is such that it extends upwardly and outwardly from the uppermost surface of the second plate 30 as at clearly shown in both FIGS. 1 and 3.

Figure 7:
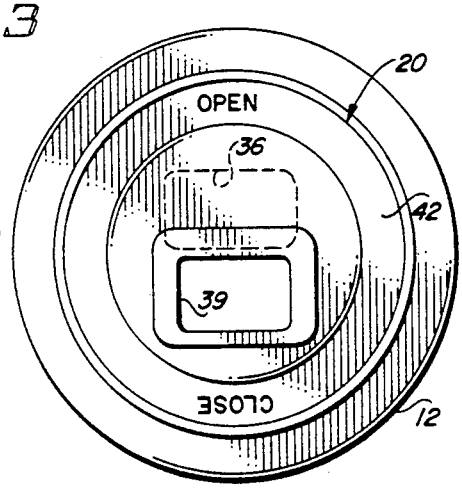
FIG. 7 is a top view of the structure of the present invention in a closed position.
Figure 8:
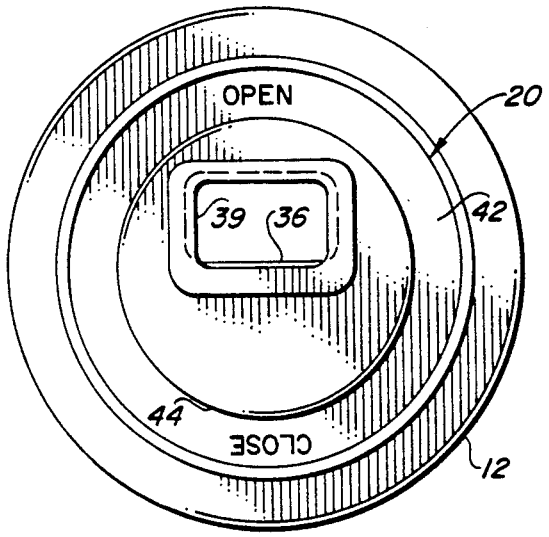
FIG. 8 is a top view of the embodiment of FIG. 7 in an open position.

With reference to both FIGS. 1, 7 and 8, it is indicated that the second plate 30 also has a passage 39 formed therein. Such passage 39 extends completely through the second plate 30 and is in direct axial alignment with the interior flow path 32 extending along the length of the applicator spoon 22 (see FIG. 3). It should be apparent therefore that at all times, when the first and second plate 29 and 30 are in their operative position (see FIG. 3), the first passage 36 of the first plate 29 is in direct communication with the interior 14 of the container 12. Similarly, the second passage 39 of the second plate 30 is at all times in fixed and direct communication with the interior of the flow path 32. Therefore, when the two passages 36 and 39 respectively formed in the first and second plates 29 and 30 are in spaced apart relation to one another as shown in FIG. 7, the valve structure is in its closed position which prevents flow of food from the interior 14 of container 12 into and along the flow path 32 of applicator spoon 22. To the contrary, when the passages 36 and 39 are in their aligned position as shown in FIG. 8, the valve structure is in its open position and a clear path of communication is established between the interior 14 of the container 12 and the interior flow path 32 of the applicator spoon 22. The food is therefore allowed to freely flow along this open path of communication upon a tilting of the container and/or the application of a slight squeezing pressure to the container since it is formed form a flexible material.

In order to selectively position the valve structure between the aforementioned open and closed positions the second plate 30 is allowed to rotate relative to the first plate 29 and to the retaining means 20. The retaining means comprises an annular collar or skirt as at 40 and an upper inwardly directed retaining flange 42. The retaining flange 42 surrounds and defines the peripheral boundaries of a central aperture 44 of the retaining means 20 (see FIG. 4).

Figure 2:
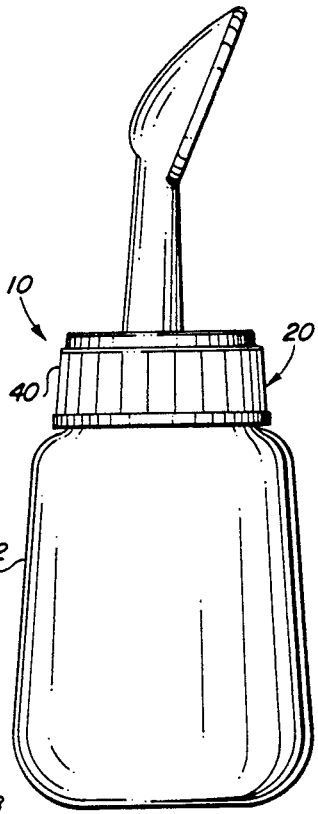
FIG. 2 is an assembled view of the embodiment of FIG. 1.
Figure 4:
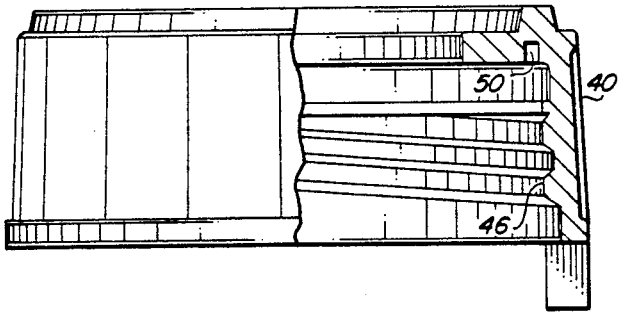
FIG. 4 is a detail and partial section of a retaining structure associated with the present invention.

As clearly shown in FIG. 4, the interior of the depending annular collar 40 is also internally threaded or otherwise structured as at 46 to be removably attached to the exterior threaded surface as at 18 adjacent the open end 16 of container 12. When in its attached position as shown in FIG. 2, the retaining flange 42 serves to effectively sandwich the first and second valve plates 29 and 30 (see FIG. 3) into confronting but movable engagement with one another. The structure of the first and second plates 29 and 30 and their independent cooperation with the retaining means 20 is such that the second valve plate 30 is allowed to rotate about a central axis upon a manual turning of the applicator spoon 22. The second plate 30 will therefore rotate relative to the first plate 29 and to the retaining means 20 when all of these elements are in their operative position as shown in FIG. 3. This rotation will have the effect of selectively positioning the passages 36 and 39 into and out of axial alignment with one another as shown in FIGS. 7 and 8 to selectively allow the valve structure to be positioned between its open and closed position.

Figure 5:
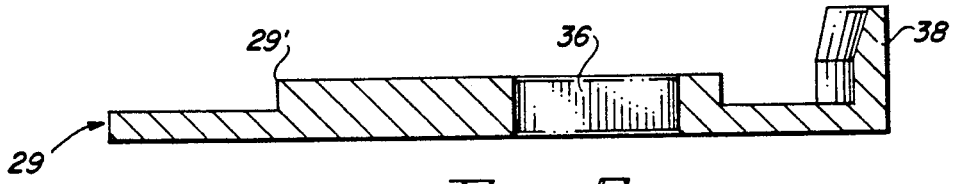
FIG. 5 is a sectional view of a portion of the valve structure of the present invention.
Figure 6:
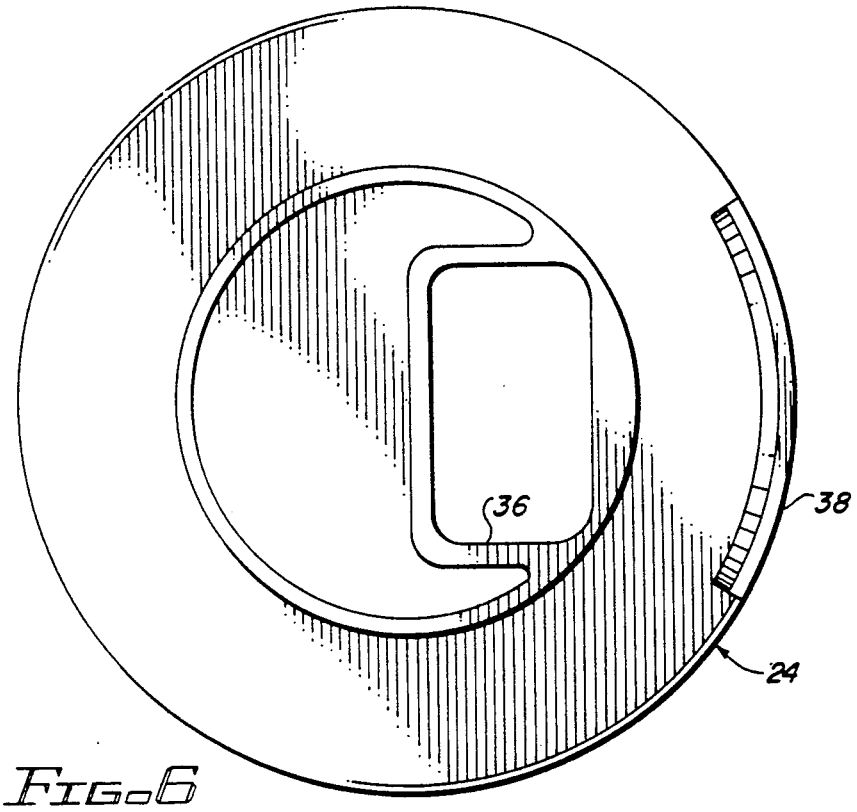
FIG. 6 is a top view of the embodiment of FIG. 5.

In order to prevent relative rotation between the first plate 29 and the retaining means 20, an upwardly extending preferably arcuate projection 38 is integrally formed on the first plate 29. This projection is designed to fit within a similarly arcuately configured recess as at 50 formed within the retaining means 20 substantially beneath the retaining flange 42 as best shown in FIGS. 3 and 4. The second valve plate 30, on the other hand, has a first segment 30' and a second segment 30'' of progressively smaller outside diameters. The second segment rises and extends through the central aperture 44 of the retaining means 20. This allows the elongated outwardly projecting applicator spoon 22 to extend outwardly from the retaining means 20 so as to have access to the infant's mouth for feeding. Cooperation between the first plate 29 and the second plate 30 is best shown in FIGS. 1 and 5 to the extent that a riser member 29' is formed on the outer or upper surface of the first plate 29 and extends into a recess on the interior of the second plate 30 for purposes of securing mating but yet rotatable engagement therebetween. Other structural features which may be included in the present invention is the provision of a protective cover as at 58 which may be transparent, translucent or opaque. This cover serves to overly and encase the spoon 22 prior to use. Also the cover 58 is completely detachable from the retaining means 20 that may also be included in the consumer packaging of the product if such is desired and practical.

Now that the invention has been described,

What is claimed is:

1. An assembly for feeding food to infants, said assembly comprising:

a. a container including a hollow interior structured to store food therein and including an open end communicating with said hollow interior, b. a retaining structure attached to said container in adjacent relation to said open end, c. an applicator means for delivering food from said container to the infant's mouth and interconnected to said container by said retaining structure in communicating relation with said open end and said hollow interior, d. said applicator means comprising an elongated hollow interior defining a flow path for food from said container to the infant, e. valve means for regulating flow of food from said hollow interior of said container to said flow path and being selectively positionable between an open position and a closed position, f. said open position defining open communication between said flow path and said hollow interior and said closed position defining closed communication between said flow path and said hollow interior, g. said valve means comprising a first plate mounted in at least partially covering relation to said open end and including a first passage extending therethrough and disposed in communication with said hollow interior of said container; and a second plate connected to said applicator means and movable therewith and rotatable therewith relative to said first plate and said retaining structure and mounted adjacent said first plate and including a second passage extending therethrough and disposed in communication with said flow path, h. said first plate and said second plate being disposed in removable, confronting relation to one another and removably and collectively sandwiched substantially within said retaining structure and in covering relation to said open end of said container, i. said retaining structure comprising a recess formed therein and said first plate comprising a projecting member extending outwardly therefrom beyond said second plate and into received engagement within said recess of said retaining structure, and j. said projecting member and recess structurally adapted to be cooperatively dimensioned and configured to prevent relevant rotation between said retaining structure and said first plate when said projecting member and said recess are engaged.

2. An assembly as in claim 1 wherein one of said first and second plates is movably mounted on said container relative to the other plate and said open and closed positions are respectively defined by aligned disposition and spaced disposition of said first and second passages.

3. An assembly as in claim 2 wherein said first plate and said second plate are disposed in engaging, coaxial relation to one another, said one plate being selectively rotatable relative to the other plate and relative to said retaining structure between said open and closed positions.

4. An assembly as in claim 3 wherein said first and second passages are disposed in a radially outward spaced location from a common central axis of corresponding ones of said first and second plates.

5. An assembly as in claim 1 wherein said retaining means comprises an annular configuration including a central aperture and a retaining flange disposed along and defining a continuous periphery of said central aperture, said applicator means extending outwardly through said central aperture and said first and second plates retained in sandwiched relation between said open end of said container and said retaining flange.

6. An assembly as in claim 1 wherein said applicator means comprises an elongated spoon structure having said innermost end secured to said second plate and movable therewith and an outermost end adapted to fit within the infant's mouth, such flow path extending from said innermost end to said outermost end along an interior length of said spoon structure.

* * * * *